US006880738B2

(12) United States Patent
Neumann et al.

(10) Patent No.: US 6,880,738 B2
(45) Date of Patent: Apr. 19, 2005

(54) PROPELLANT CHARGE MAGAZINE FOR A SETTING TOOL

(75) Inventors: Jens Neumann, Feldkirch (AT); Tilo Dittrich, Feldkirch (AT); Thomas Sperrfechter, Zizers Gr (CH); Norbert Heeb, Buchs (CH); Mario Scalet, Scaan (LI)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/365,818

(22) Filed: Feb. 12, 2003

(65) Prior Publication Data

US 2003/0155397 A1 Aug. 21, 2003

(30) Foreign Application Priority Data

Feb. 15, 2002 (DE) ..... 102 06 586

(51) Int. Cl.[7] ..... F41A 9/79; B25C 1/14

(52) U.S. Cl. ..... 227/10; 89/34.14; 89/35.01

(58) Field of Search ..... 89/33.1, 33.14, 89/33.2, 35.01, 1.14; 102/281, 530, 531; 227/10, 135, 136, 9

(56) References Cited

U.S. PATENT DOCUMENTS

| | | | | | |
|---|---|---|---|---|---|
| 2,043,256 | A | * | 6/1936 | McLeod, Jr. | 102/373 |
| 3,009,156 | A | * | 11/1961 | Hershey | 227/88 |
| 3,517,804 | A | * | 6/1970 | Faulkner | 206/338 |
| 3,632,032 | A | | 1/1972 | Termet | |
| 3,756,118 | A | * | 9/1973 | Ratz et al. | 89/33.1 |
| 4,047,611 | A | * | 9/1977 | Damratowski | 206/347 |
| 4,129,941 | A | * | 12/1978 | Zahn | 29/753 |
| 4,204,473 | A | | 5/1980 | Dardick | |
| 4,462,160 | A | * | 7/1984 | Cohen et al. | 33/760 |
| 5,251,532 | A | * | 10/1993 | Frommelt et al. | 89/1.14 |
| 5,560,529 | A | * | 10/1996 | Udagawa et al. | 227/136 |
| 5,811,717 | A | * | 9/1998 | Day et al. | 89/35.01 |
| 6,050,471 | A | * | 4/2000 | Yagi | 227/119 |
| 6,053,108 | A | * | 4/2000 | Remerowski | 102/204 |
| 6,371,351 | B1 | * | 4/2002 | Magnusson | 227/119 |
| 6,568,579 | B1 | * | 5/2003 | Mochizuki | 227/131 |
| 6,604,665 | B1 | * | 8/2003 | Gabriel | 227/120 |

FOREIGN PATENT DOCUMENTS

GB 1330336 9/1973

OTHER PUBLICATIONS

Search Report of the French Patent Office.

* cited by examiner

*Primary Examiner*—Stephen F. Gerrity
(74) *Attorney, Agent, or Firm*—Sidley Austin Brown & Wood, LLP

(57) ABSTRACT

The present invention relates to a propellant charge magazine for setting tools and a setting tool for driving fasteners into a substrate. The propellant charge magazine of the invention comprises a housing (24) with an internal housing space for receiving a magazine strip with propellant charges (22). At least one output opening (26) for inserting and extracting the magazine strip (21) is arranged on the housing. A first space (27) for receiving a rolled up magazine strip (21) is provided on the propellant charge magazine (20) and a second space (28) in contact with the first space (27) via an opening (29) and for accommodating part (31) of the magazine strip (21) that is re-introduced into the propellant charge magazine (20) is provided on the propellant charge magazine (20).

15 Claims, 15 Drawing Sheets

PROPELLANT CHARGE MAGAZINE FOR A SETTING TOOL

BACKGROUND OF THE INVENTION

The present application relates to a propellant charge magazine for a setting tool for driving fastening elements such as nails, bolts, pins and the like into a substrate. The aforementioned propellant charge magazines can be provided with powder charges in tablet or cartridge form as the propellant, which are fired in the setting tool for effecting the setting operation.

In modern setting tools, the tablets or cartridges are grouped together in magazine strips on which a plurality of pill charges, in blisters, or powder charges, in cartridges, are arranged. The propellant charge magazine strips can be blister or cartridge strips.

In use, the magazine strips are inserted into a feeder disposed on the setting tool and conveyed into the device (manually or automatically). One charge is brought into one cartridge holder respectively by the conveyance. The blister or cartridge strips are then automatically further transported in the device, when a setting operation is completed, so that the unused charge reaches the cartridge holder. DE 199 01 268 A1 discloses such a setting tool.

Magazine strips of considerable length have been proposed to enable the user of setting tools to use as may setting operations as possible without having to change the cartridge, blister or magazine strips required for the setting operations. U.S. Pat. No. 4,204,473, upon which the present patent application is based, describes a cartridge strip having a plurality of powder charges, which is arranged in a magazine box. The cartridge or magazine strip is arranged in layers in the box.

The drawback in this magazine arrangement is that the drawing force that is required to extract the strips from the magazine box is inconsistent. Moreover, an increased traction force must be expected when a loop lies directly in front of the output opening of the magazine. Furthermore, removing and returning a partially emptied magazine box results in the problem that the magazine strip in a majority of instances is in an undefined position, in which it cannot be transported by the transport mechanism of the magazine box. Once a magazine strip is removed from the magazine box it can be pushed back into the box only with difficulty because the strips left in the box take up the entire inner space of the magazine box due to the expansion of the strip material.

U.S. Pat. No. 6,053,108 discloses pill charges and powder charges disposed in blisters or magazine strips in cartridge strips, which can be spirally coiled and which can contain a plurality of charges. These magazine strips are supplied to a setting tool but without a protecting magazine case.

SUMMARY OF THE INVENTION

The object of the present invention is to provide a magazine for propellant charges, which avoids the aforesaid drawbacks and which provides simple and convenient use.

The object is achieved according to the invention by a propellant charge magazine comprising at least two spaces. A first space receives a rolled up magazine strip and a second space in contact via an opening with the receiving space for the magazine strips, which can serve as a stowage area or receptacle for a part of the magazine strip. The second space cannot be rolled up again onto the magazine strip roll when the magazine strip is pushed back into propellant charge magazine. This part of the magazine strip can then be accommodated in the stowage area or receptacle. Thus, by virtue of this measure, it is possible for the propellant charges of the strip that are still unused and remain in the device to be conveyed back into the propellant magazine, so that upon removal of the propellant charge magazine no unfired propellant charges remain in the device, which could represent a risk to the user of the setting tool.

In one advantageous embodiment of the propellant charge magazine, the first space is enclosed in an at least partially cylindrical guide surface, in which the opening to the second or to the receiving space is arranged. This arrangement enables easy rolling of the rolled up magazine strip and assures that the magazine strip roll, when it is partially unrolled, expands due to the tension inherent in the plastic material of the magazine strip and occupies the entire inside space of the propellant charge magazine. Such an arrangement prevents the magazine strip from being pushed back into the magazine.

The stowage space offers the advantage that the entire coil or the entire magazine strip roll need not be turned when the propellant charge strip is pushed back. The strip can be pushed back into the available stowage space with relatively little resistance. Such an arrangement reduces the necessary force required of the operator when using the device and consequently increases the operator's comfort.

Preferably, the propellant charge magazine is provided with a retaining member for the end zone of the magazine strip, by which a complete extension of the magazine strip from the propellant charge magazine is prevented or at least blocked. As a result, the end zone, in which generally no propellant charges are disposed, is prevented from being drawn into the device and causing problems therein.

Preferably, the opening in the cylindrical guide surface is configured such that one of its edges, particularly the edge arranged in the extension direction of the magazine strip, forms the retention member for the end zone of the magazine strip. The retention member can be configured in a simple fashion. In a further variant, the retention member is formed by an edge disposed at least on one guide ridge for the magazine strip.

Preferably, stop or counter members are provided on the magazine strip situated in the propellant charge magazine, which co-operate with the retention members or engage them, when the magazine strip is pulled from the propellant charge magazine up to the end zone. Further drawing out of the magazine strip from the propellant charge magazine is prevented with the highest degree of reliability through the engagement of the stop or counter members with the retention member(s) arranged on the propellant charge magazine.

A means is provided on the magazine strip for bringing about a no-load run of the forward feed mechanism of the setting tool. This means can, for instance, include an opening whose length is greater or equal to the transport stroke of each transport member of the forward feed mechanism of the setting tool. Through this feature, the forward feed of the magazine strip is ended by the setting device, when the means or the opening in the end zone of the magazine strip comes to rest over the transport member of the forward feed mechanism of the setting tool.

Recesses are also provided on the propellant charge magazine for the transport of the magazine strip so that the transport member can reach through the magazine box.

The propellant charge magazine according to the invention protects the propellant charge magazine strip from direct environmental factors (mechanical deformation, water, water vapor brake, undesirable effects of electrostatic charge). Furthermore, interface elements are provided on the propellant charge magazine, that enable simple charging and discharging of the setting tool. Geometrical elements for form-locking fastening of the box on the device (groove, pins, webs, rails) are included in said interface elements.

A mechanism is provided on the propellant charge magazine for positioning the magazine strip. This positioning mechanism is used for holding the propellant charge strip, for example, during temporary removal from the setting tool in a defined position inside the propellant charge magazine. In this fashion, the correct position of the magazine strip is assured when reloading the setting tool with a propellant charge magazine already started. The positioning mechanism prevents the operator of the setting tool from unintentionally pulling the magazine strip from out of the box. During transport of the magazine strip or generally, when the propellant charge magazine is in the setting tool, the positioning mechanism is moved into a release position by a control element in the tool. The mechanism comprises a blocking element, which in a first position clamps the magazine strip and thus blocks a transport movement of the magazine strip and in a second position releases the magazine strip so that the magazine strip can be transported through the setting tool.

In a preferred embodiment of the propellant charge magazine, the positioning mechanism is configured such that the locking element, on introduction of the propellant charge magazine into the magazine inlet of a driving tool, can automatically be switched over from the locked position to the release position.

Preferably, the locking elements in the propellant charge magazine each have a locking member, which engages in or at least on a counter locking element on the magazine strip. These locking members can, for example, be configured as a mandrel, pin, or projection. If the locking elements are resiliently loaded in the direction of their locked position, for example, using a separate spring element or it is itself at least in part resiliently configured, then the locking elements alone can be switched, using the spring loading, back into their locked position when the propellant charge magazine is removed from the magazine inlet.

The positioning mechanism assures that the propellant charge strip is always correctly positioned when the propellant charge magazine is inserted into the device such that the transport mechanism can consistently position the next unused propellant charge exactly in the cartridge holder and malfunction does not occur. Furthermore, propellant charges cannot be removed from the propellant charge magazine by improper handling. Transport movement-related shocks and vibrations also have no affect on the position of the first propellant charge.

A further object of the present invention is to provide a setting tool for receiving the propellant charge magazine according to the invention having a plurality of adjusting means arranged in the area of the magazine inlet, by which one or a plurality of locking elements that are disposed either directly on the propellant charge magazine or otherwise on the magazine strip and which prevent a transport movement of the magazine strip from its locked position in the locking elements, can be reversibly switched into a release position in which the locking element(s) release the magazine strip for transport. Easy handling of the setting tool is achieved using the propellant charge magazine according to the invention. Simple plugging in or insertion of the propellant charge magazine into the magazine inlet of the setting tool suffices since the operator does not need to perform any special procedures for unlocking the locking element on the propellant charge magazine.

SUMMARY OF THE INVENTION

The preferred embodiments of the invention are described in the following description with reference to the drawings, wherein.

Figure 11A:
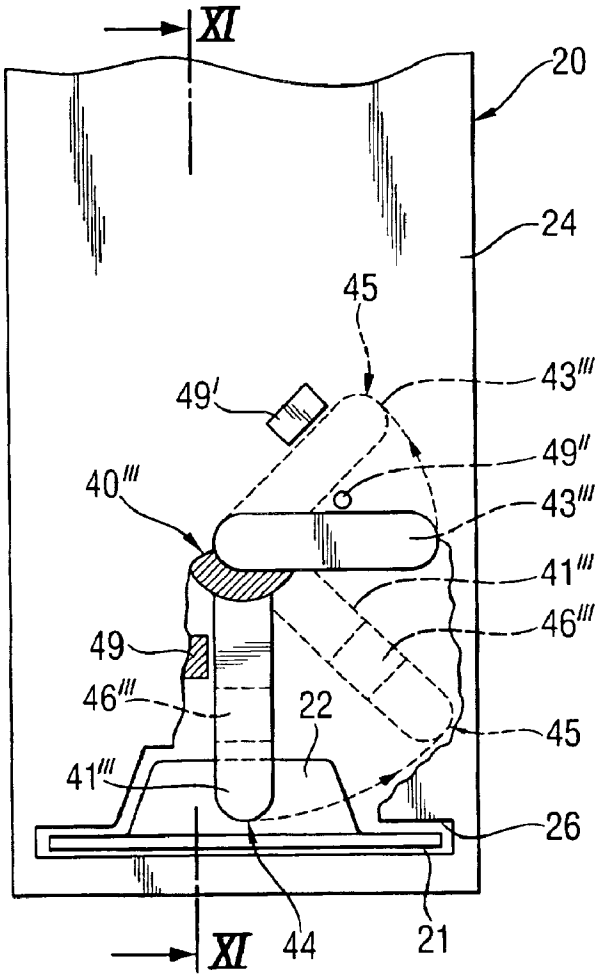
Figure 11B:
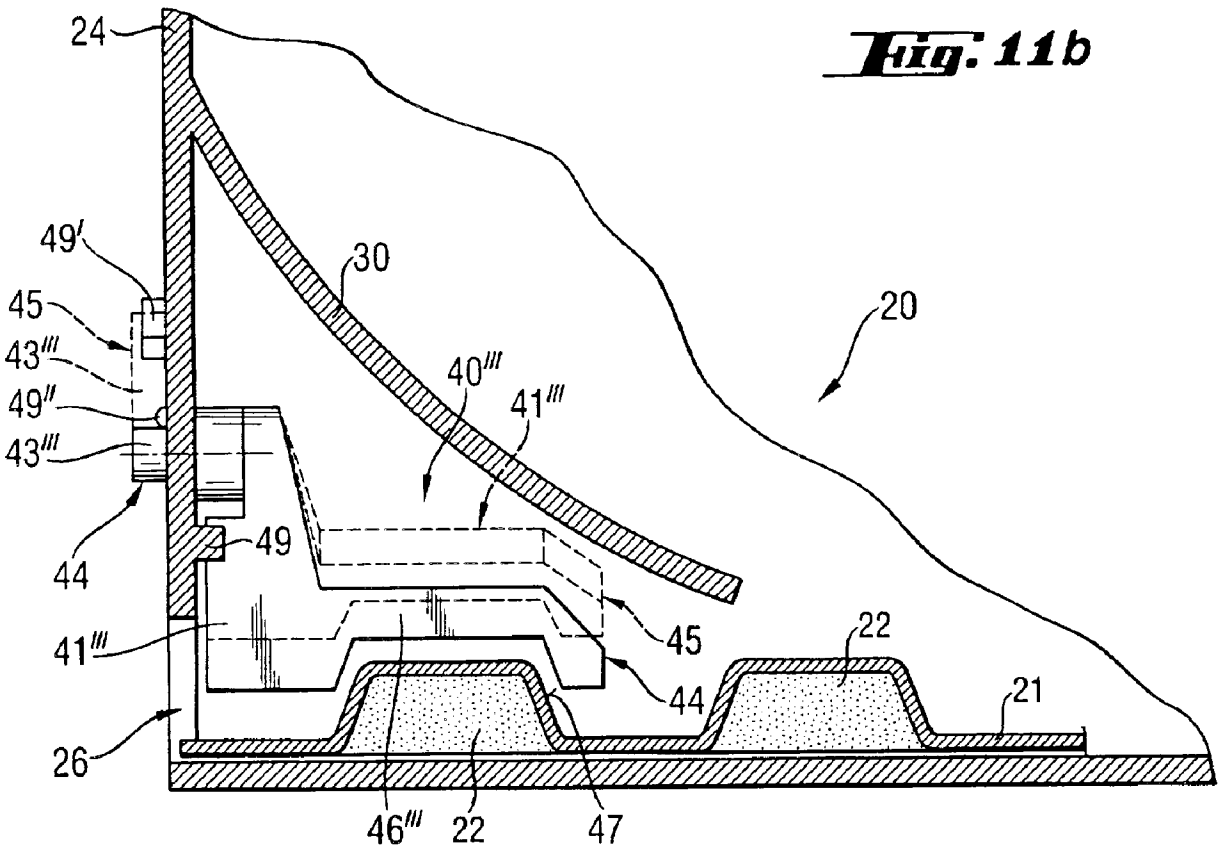

FIG. 11*a* shows a fifth embodiment of a propellant charge magazine according to the invention in cut-out presentation with a view onto the outlet opening for the magazine strip;

FIG. 11*b* shows the propellant charge magazine of FIG. 11*a* in a section taken along the Line XI—XI of FIG. 11*a*.

Figure 12:
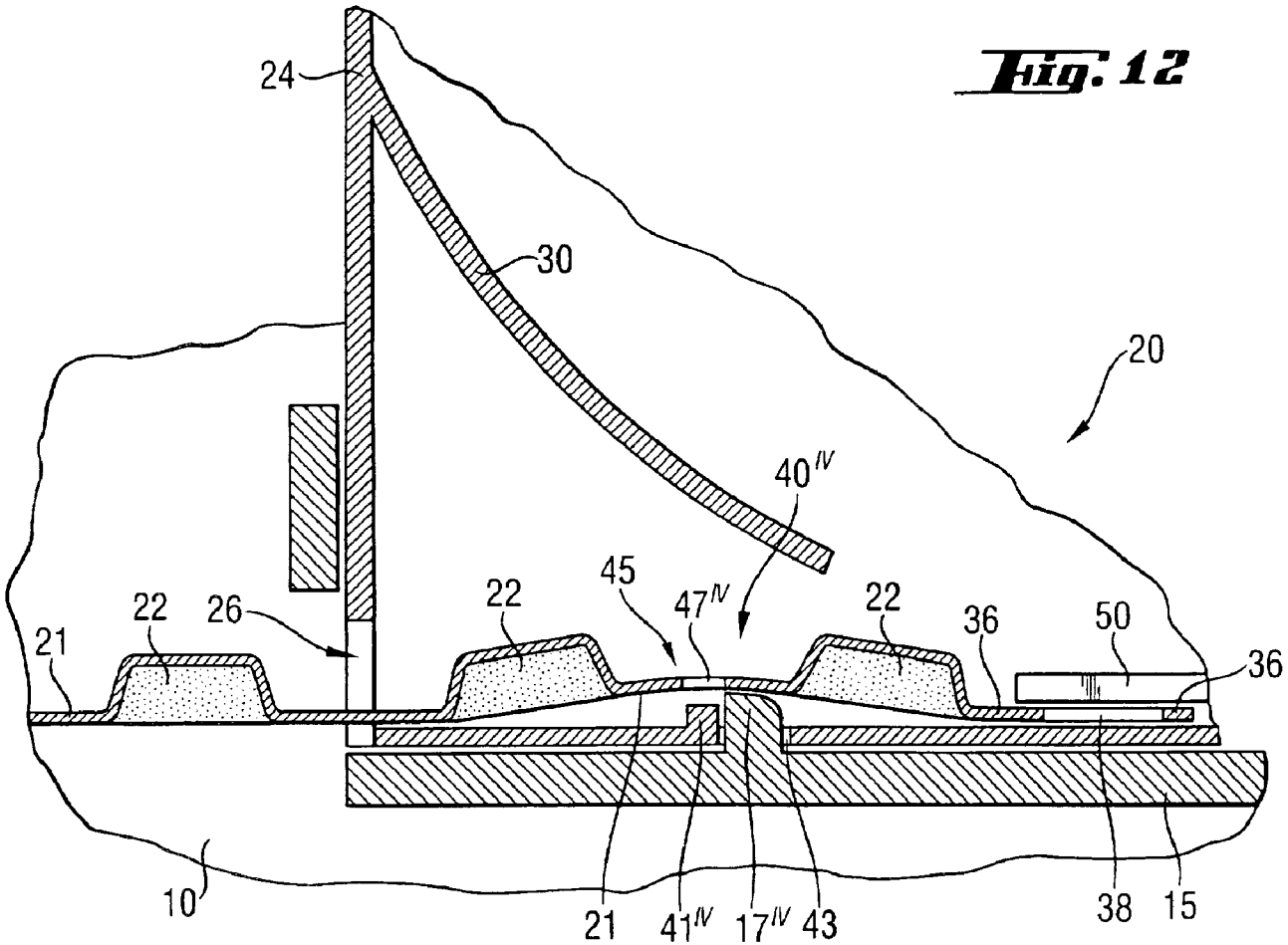
Figure 13:
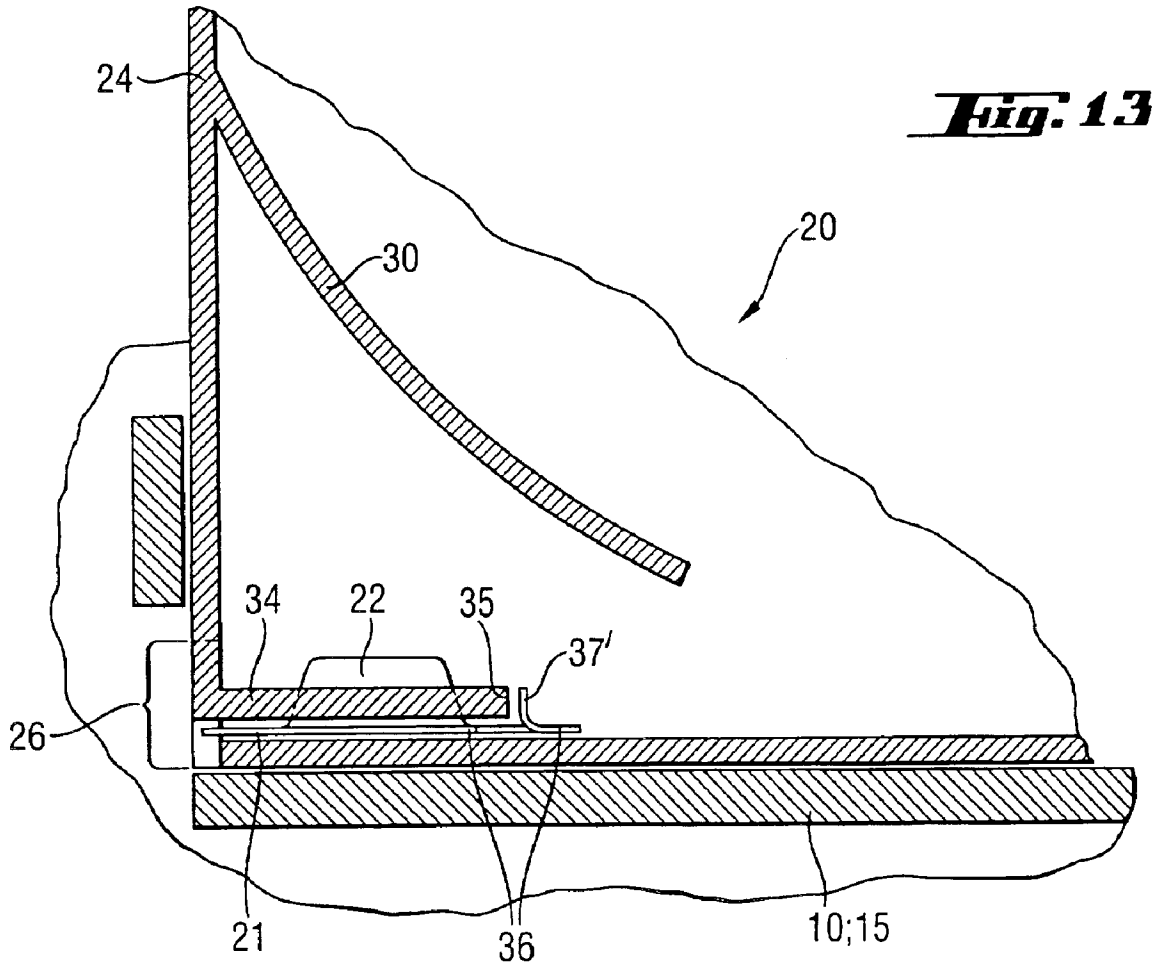
Figure 14:
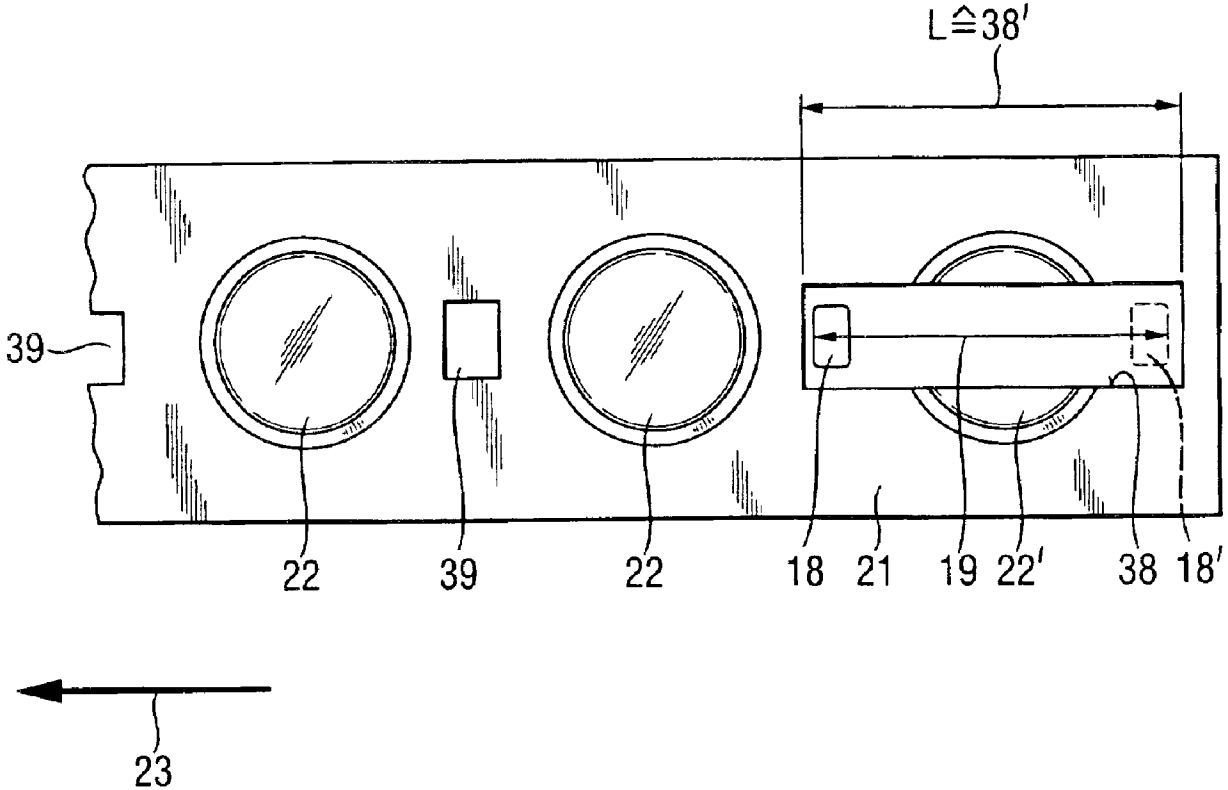

FIG. 12 shows a sixth exemplary embodiment of a propellant charge magazine according to the invention in cross-section and in cut-out presentation;

FIG. 13 shows a seventh exemplary embodiment of a propellant charge magazine according to the invention in cross-sectional view;

FIG. 14 shows the end zone of a magazine strip according to the invention in a top view.

DETAILED DESCRIPTION OF THE INVENTION

Figure 1:
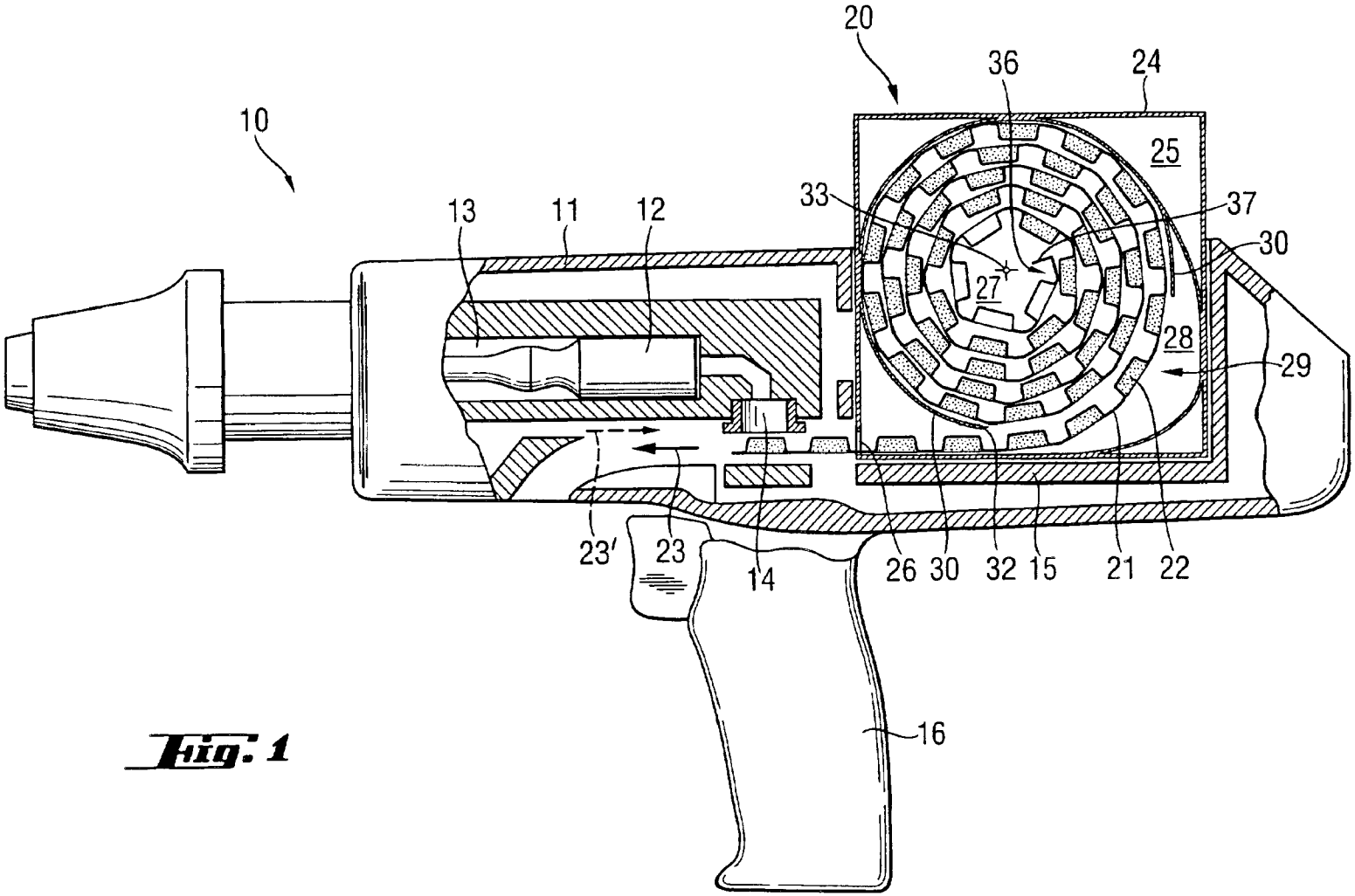
FIG. 1 shows a setting tool according to the invention, in a partial longitudinal section, with a propellant charge magazine arranged in the magazine inlet.

In FIGS. 1 to 4 a first embodiment of the propellant charge magazine according to the invention. In FIG. 1 a strongly schematized setting tool 10 is represented, which is described in the following as an example. This setting tool 10 has a housing 11, in which the setting mechanism is situated, which contains a driving piston 12 arranged in a piston barrel 13 or piston chamber and a cartridge holder 14 for receiving a cartridge or a propellant charge 22. If a propellant charge 22 disposed in the cartridge holder 14 is fired, then the driving piston 12 is driven away from the cartridge holder by the expanding explosion gases and can perform setting work 10 in such a fashion as, for example, driving a nail or bolt disposed in the bolt chamber of the setting tool 10 into a substrate. The device represented here further comprises a hand grip 16, on which a trigger or switch is arranged and using which firing of a propellant charge 22 (not represented herein) disposed in the cartridge holder, can be initiated.

The setting tool 10 represented here further possesses a magazine inlet 15, in which a propellant charge magazine 20 according to the invention is arranged.

Further, a transport mechanism for transporting the magazine strip 21 (not represented herein) is arranged in the setting tool 10. Using this transport mechanism, the magazine strip can be transported in the extraction and feed advance direction 23 by the device, so that after performing a setting operation a fresh propellant charge 22 is consistently inserted in the cartridge holder 14 and can be accommodated therein. If the propellant charge magazine 20 is again removed from the setting tool, then the magazine strip 21 can again be moved into the reverse transport direction 23', thus in the propellant charge magazine, using the transport mechanism of the setting tool.

Figure 2:
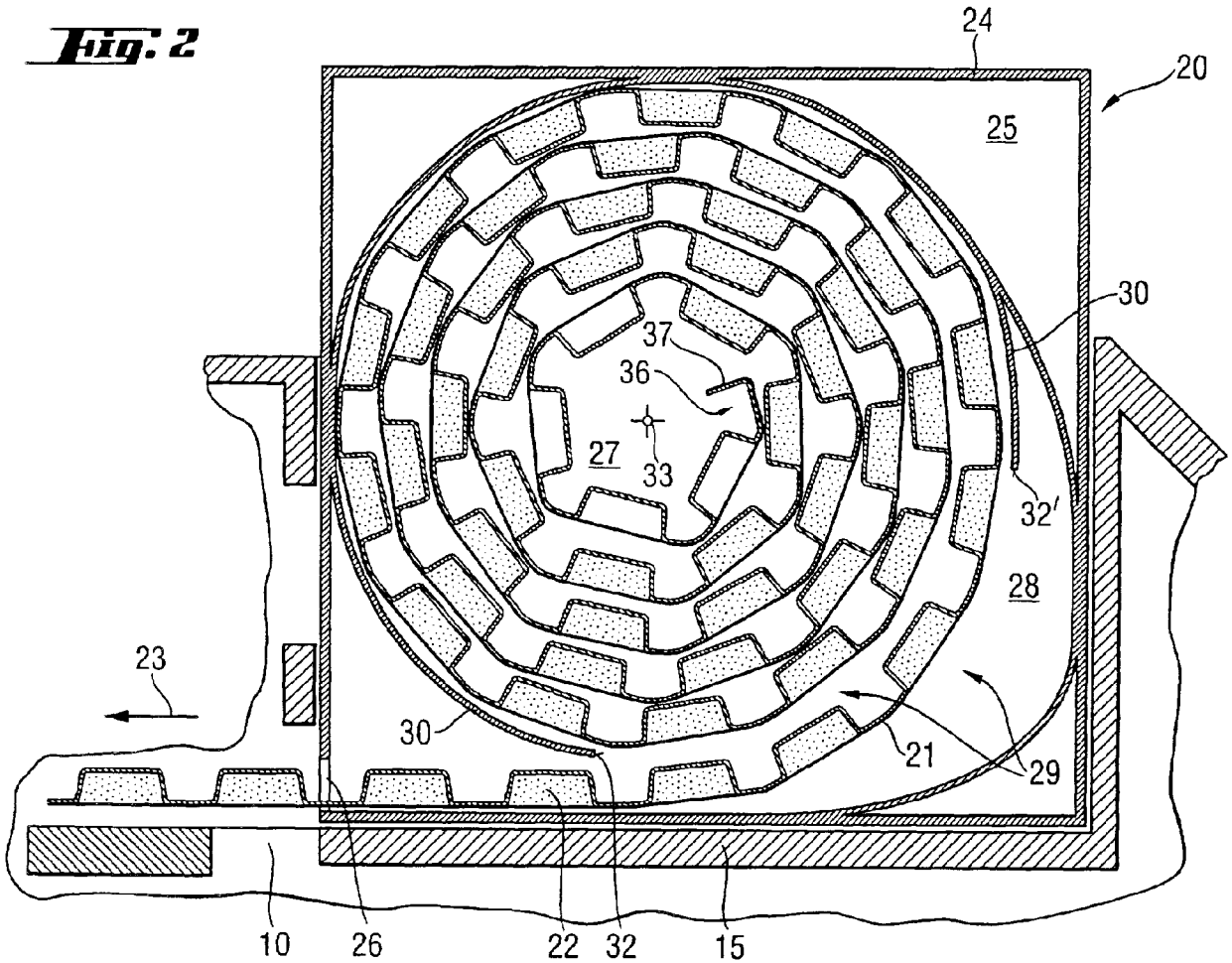
FIG. 2 shows a propellant charge magazine according to the invention, in a magazine inlet of a setting tool.

The propellant charge magazine 20 according to the invention will be more completely described with reference to FIGS. 2 and 3. In FIG. 2 the propellant charge magazine 20 of FIG. 1 and the magazine inlet 15 of the setting tool 10 is represented in an enlarged illustration. The propellant charge magazine 20 is comprised of a housing 24—in the present exemplary embodiment configured as a rectangle—in which a guide surface 30 is arranged—in the present exemplary embodiment in the form of an open, flat cylinder. This guide surface 30 is arranged in the inside space 25 of the propellant charge magazine. It runs in the propellant charge magazine 20 substantially parallel to the roll axis 33 of a magazine strip 21 that is rolled up in the propellant charge magazine 20—in the present exemplary embodiment represented as a blister strip. This magazine strip can, for example, be configured also as a cartridge strip. The individual propellant charges 22 contain tablets comprised of an explosive material, which can be detonated in the cartridge chamber.

The guide surface 30 in the present exemplary embodiment encompasses a first space 27 which acts as the receiving space for the rolled up magazine strip 21. An opening 29 is disposed in the guide surface 30 by way of which the space 27 is in contact with a second space 28, which acts as the stowage or uptake space for a part 31 (compare FIG. 3) of the magazine strip 21 that has been pushed back in. The opening 29 is delimited by the edges 20 and 20' of the guide surface 30. The propellant charge magazine 20 has at least one outlet opening 26, through which the magazine strip 21 moves out in the advance direction 23 from the propellant charge magazine 20 and over which it can be moved in the reverse transport direction 23' back into the propellant charge magazine 20 (compare FIG. 3). In the end zone 36 of the magazine strip 21 a stop element 37 is further arranged—represented hook shape in the present exemplary embodiment. The function of this stop element will be more completely explained later with reference to FIG. 4.

Figure 3:
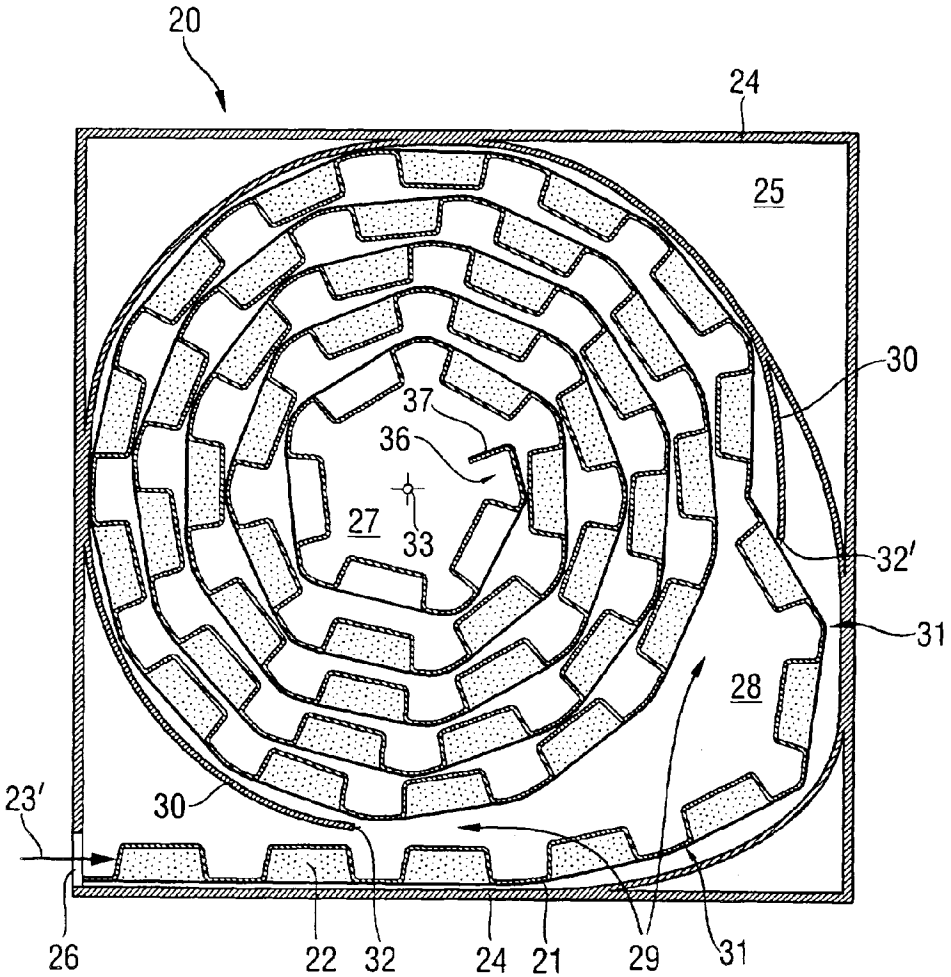
FIG. 3 shows the propellant charge magazine of FIG. 2 with a partially inserted magazine strip.

FIG. 3 represents the propellant charge magazine of FIG. 2 but in the propellant charge magazine 20 herein represented the magazine strip 21 is transported back into the propellant charge magazine 20 in the direction 23' indicated by the arrow. The returned part 31 of the magazine strip 21 is then accommodated in the stowage or uptake space 28 of the propellant charge magazine 20. The return of the magazine strip 21 into the propellant charge magazine 20 therefore does not require great power input, but can be effected in a simple manner by the transport mechanism or manually by the operator. If necessary, a closure mechanism can be provided on the propellant charge magazine 20, using which the outlet opening 26 of the propellant charge magazine 20 can be closed after complete insertion of the magazine strip 21.

Figure 4:
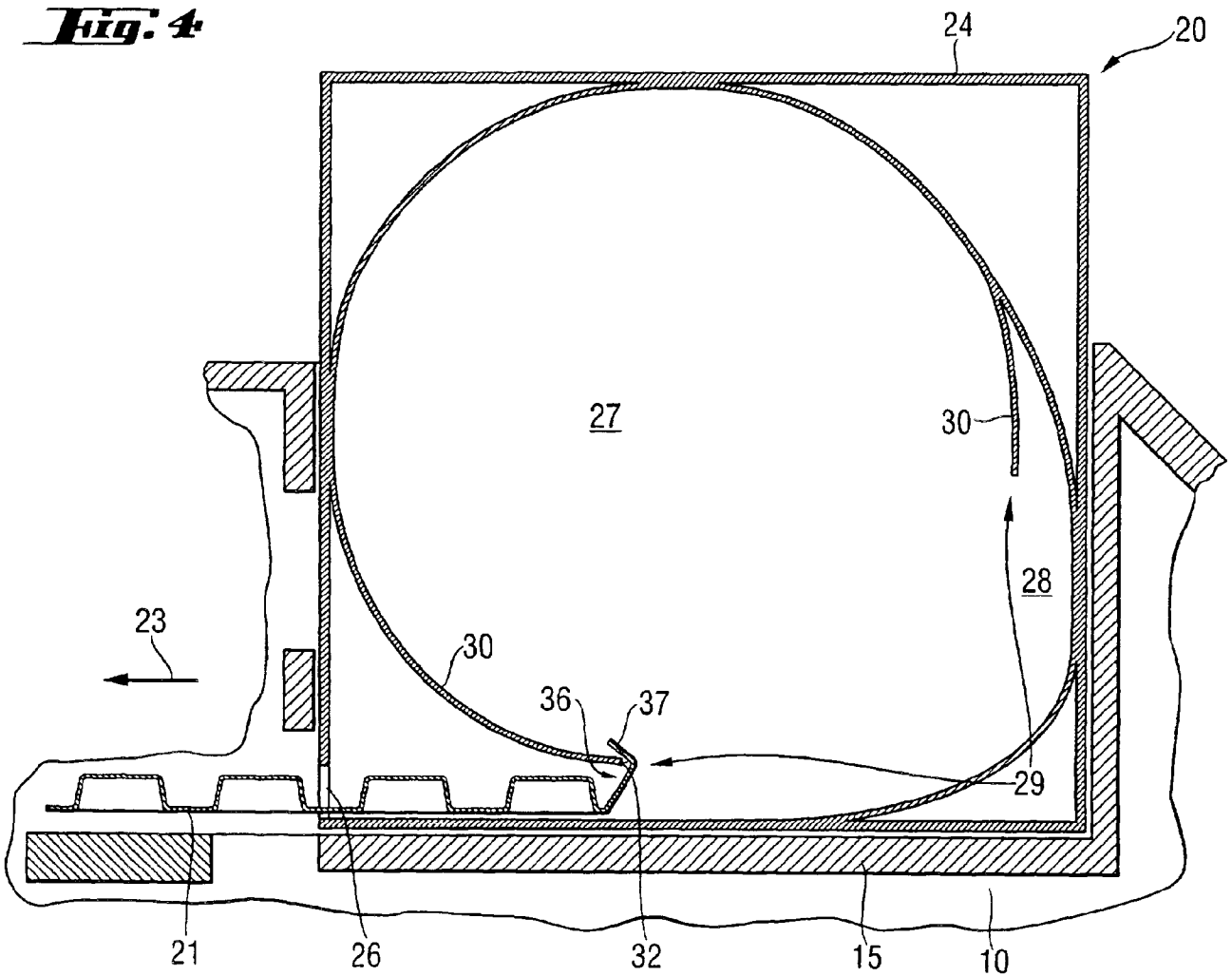
FIG. 4 shows the propellant charge magazine of FIG. 2 in a magazine inlet of a setting tool with the magazine strip almost completely withdrawn.

FIG. 4 represents the propellant charge magazine 20 of FIG. 2 wherein the magazine strip 21 has now been completely moved out of the first space 27. The stop element 37, which is represented herein as a hook-shaped device, of the end zone 36 of the magazine strip 21 is, with further transport of the magazine strip 21, run up to the retention element 32 or the first edge of the guide surface 30, so that further transport in the advance direction 23 is no longer possible. The last three or four or even more empty blisters, in which there is no more propellant charge, found in the end zone 36, cannot therefore be transported any farther into the setting tool. The magazine strip 21 can again be taken out of the setting tool 10 together with the propellant charge magazine 20 when same is removed from the tool.

FIG. 13 represent a further embodiment of a retention element on the propellant charge magazine 20 and a further stop element 37' on the magazine strip 21. In the lower area of the propellant charge magazine guide ribs or ridges 34 can be arranged, by means of which the magazine strip 21 is guided in front of the outlet opening 26. The terminal edge 35 of the guide rib/guide ribs 34 can be configured as a retention element for a projection, hook or a thickening in the end zone 36 of the magazine strip 21. Also in the case of this variant, the magazine strip 21 with its end zone 36 remains in the propellant charge magazine 20, so that it can no longer be transported farther into the setting tool and it can be removed from the setting tool together with the propellant charge magazine 20, after removal of the propellant charge magazine 20 from the setting tool, when the propellant charge magazine 20 is removed.

FIG. 14 represents the end zone of a magazine strip 21 according to the invention. In this magazine strip means 39 are centrally arranged, which are used for advancing transport of the magazine strip in the advance direction 23 or in the reverse transport direction 23' by means of a transport member 18 or 18' of the transport mechanism of the setting tool. These means 39 are configured in the present embodiment exemplary as openings. In the area of the last propellant charge sleeve 22' a means 38 configured as an opening is arranged, by which prevents the transport member 18 or 18' from transporting the magazine strip even farther in the advance direction 23. This is achieved in that the length 39' of the opening 38 is greater than the maximum transport stroke 19 between the first position of the transport member 18' and the second position of the transport member 18. The transport member 18 runs thereafter into space, without effecting an advance of the magazine strip 21. It must yet be noted at this point, that in lieu of the transport openings a serration or an adhesive strip can be provided on the magazine strip for transporting the magazine strip. At the end of the magazine strip then according to the invention no such transport means or opening would have been provided; at the point at which an appropriately configured transport element of the setting tool would have normally engaged.

Figure 5:
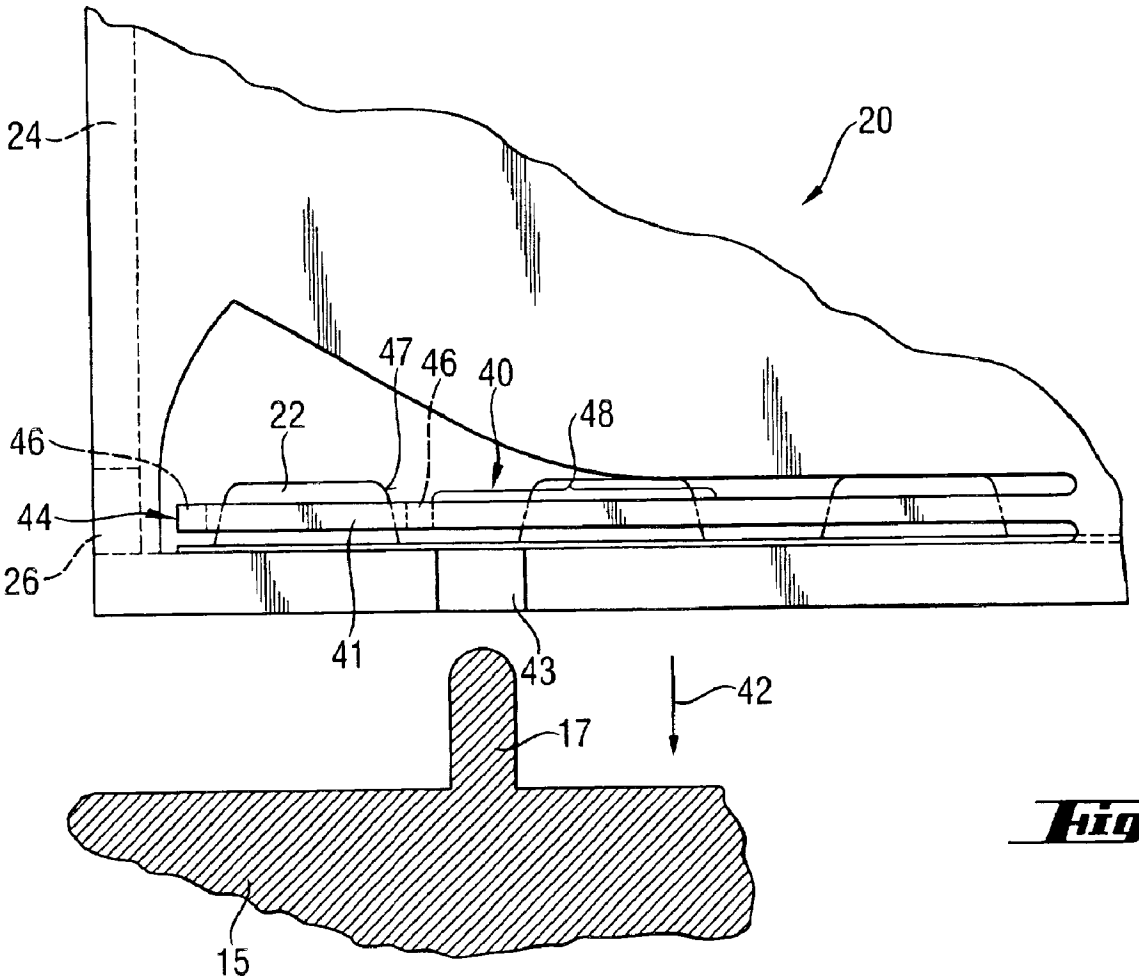
FIG. 5 shows a further embodiment of a propellant charge magazine in cut-out lateral view with a magazine inlet of a setting tool in partial section.
Figure 6:
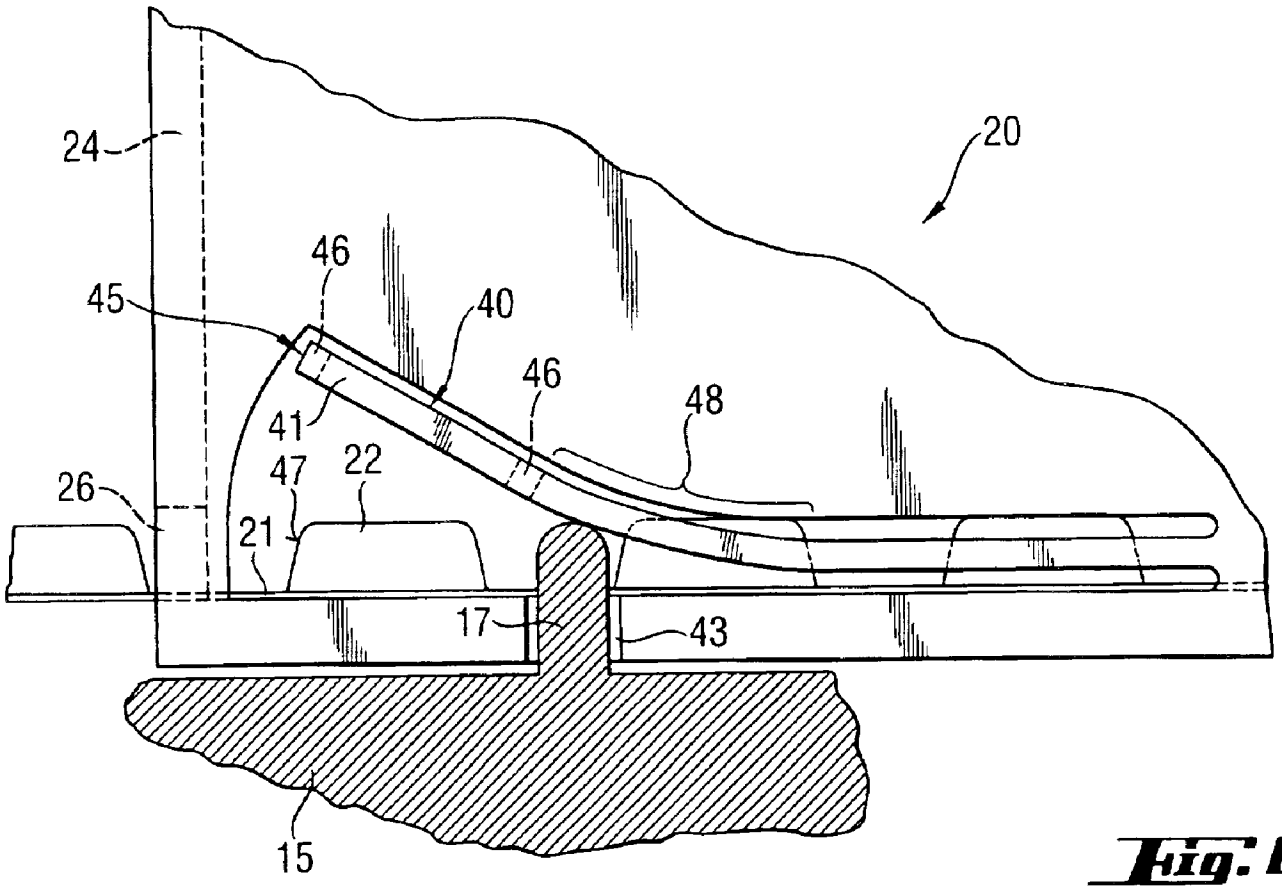
FIG. 6 shows the propellant charge magazine of FIG. 5 that has been inserted into the magazine inlet.
Figure 7:
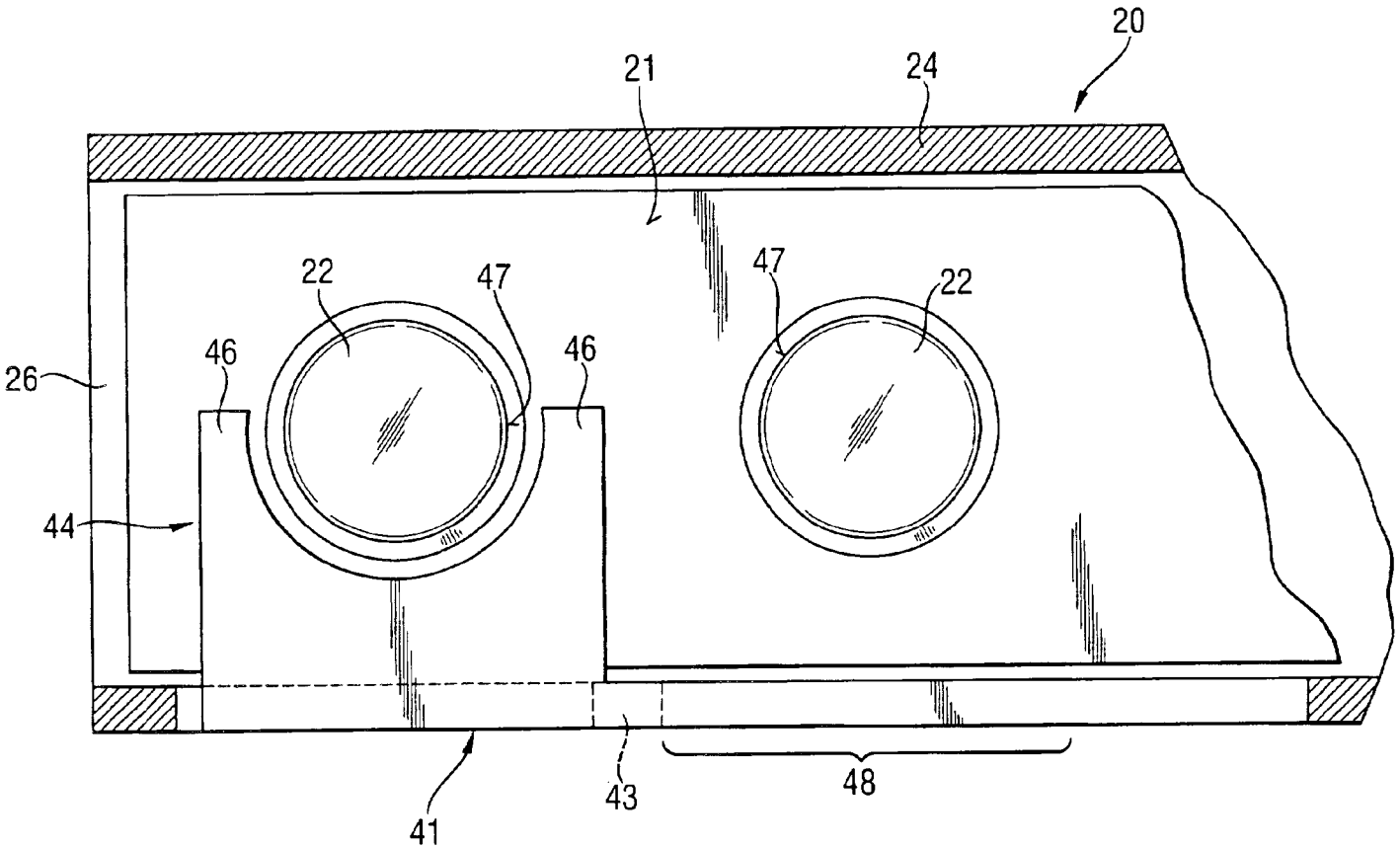
FIG. 7 shows the propellant charge magazine of FIG. 5 in a sectional view parallel to the magazine strip onto the magazine strip.

FIG. 5 is a further embodiment of a propellant charge magazine 20 and a magazine receptacle according to the invention represented in partial view. In this instant exemplary embodiment a mechanism 40 for positioning the magazine strip is arranged in the bottom area of the propellant charge magazine 20 ahead of the output opening 26 for the magazine strip. This mechanism 40 includes a locking element 41, which, as can be seen in FIGS. 6 and 7, is configured as a locking fork. In the first position, the locking position 44 of the locking element 41, engages the latter with its locking members 46 on the propellant charge 22 configured as a counter locking member 47 of the magazine strip (compare FIGS. 5 and 7). On the setting tool, a locking means 17 is arranged, for example on the bottom surface of the magazine receptacle 15, which is configured as a pin in the present exemplary embodiment. If the propellant charge magazine 20 is inserted into the magazine receptacle 15 of a setting tool (in the direction of the arrow 42), then the locking means 17 can pass through an opening 43 in the propellant charge magazine 20 and press against the locking element 41. The locking element 41 has at least one resilient area 48, so that it can be passed, as shown in FIG. 6, by passing the locking member upwards, from its locking position into its release position 45. Transport of the magazine strip 21 is no longer possible.

Figure 8:
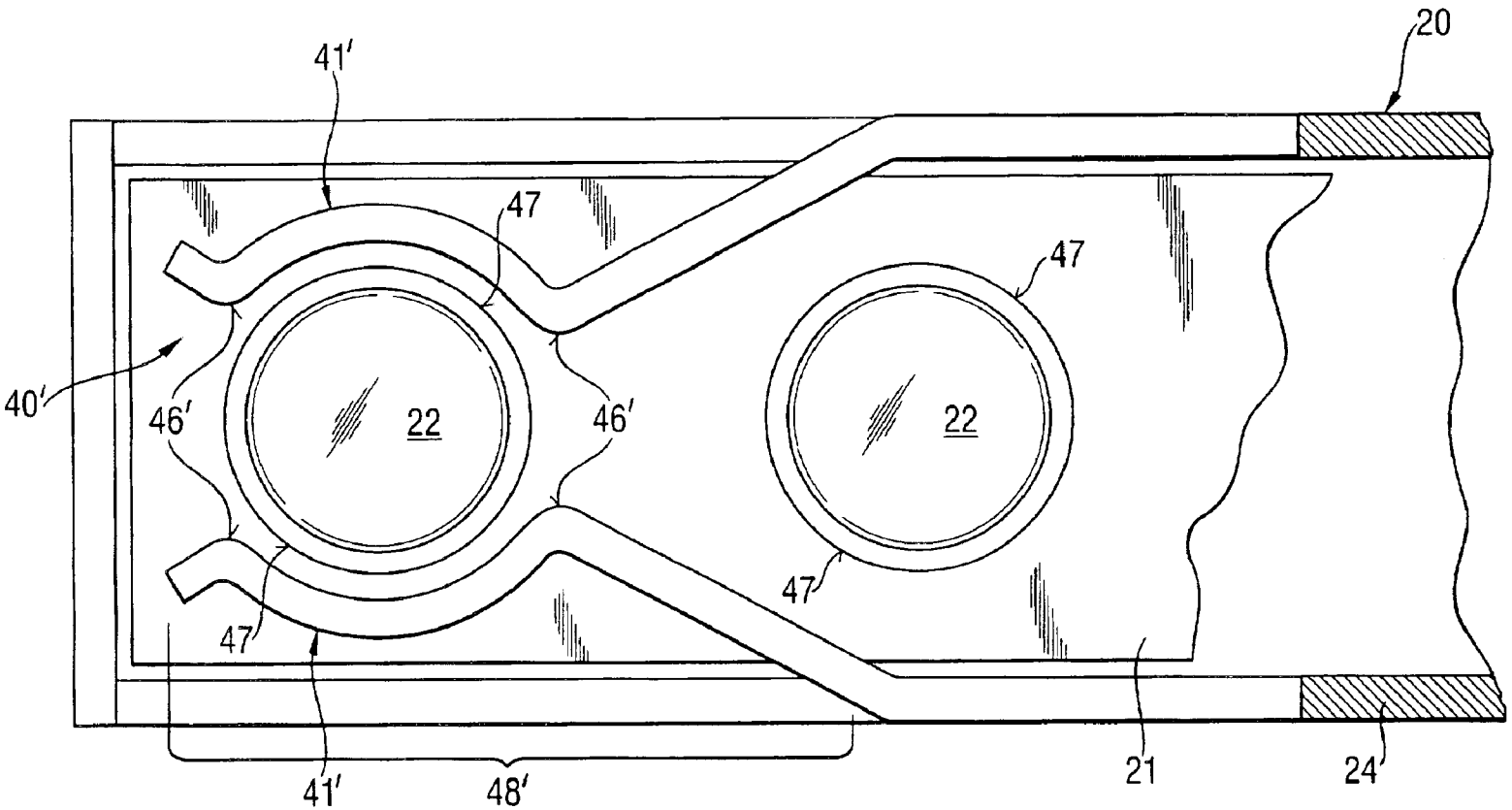
FIG. 8 shows a third embodiment of a propellant charge magazine according to the invention in a cross-sectional presentation parallel to the magazine strip with a view onto the magazine strip.

FIG. 8 represents a further exemplary embodiment of a propellant charge magazine 20 according to the invention. The mechanism 40' for positioning the magazine strip 21 includes in the present exemplary embodiment two locking elements 41' configured as locking cams. These locking elements 41' comprise a resilient area 48' at which the locking members or projections 46' are also disposed, which encompass propellant charges 22 configured as counter locking members 47 and fix them in their positions. If the magazine strips are further transported by the transport mechanism of the setting tool, then the spring force of the two locking cams 41' must merely be overcome, in order to transport the magazine strip 21 by one propellant charge 22 farther into the setting machine.

Figure 9:
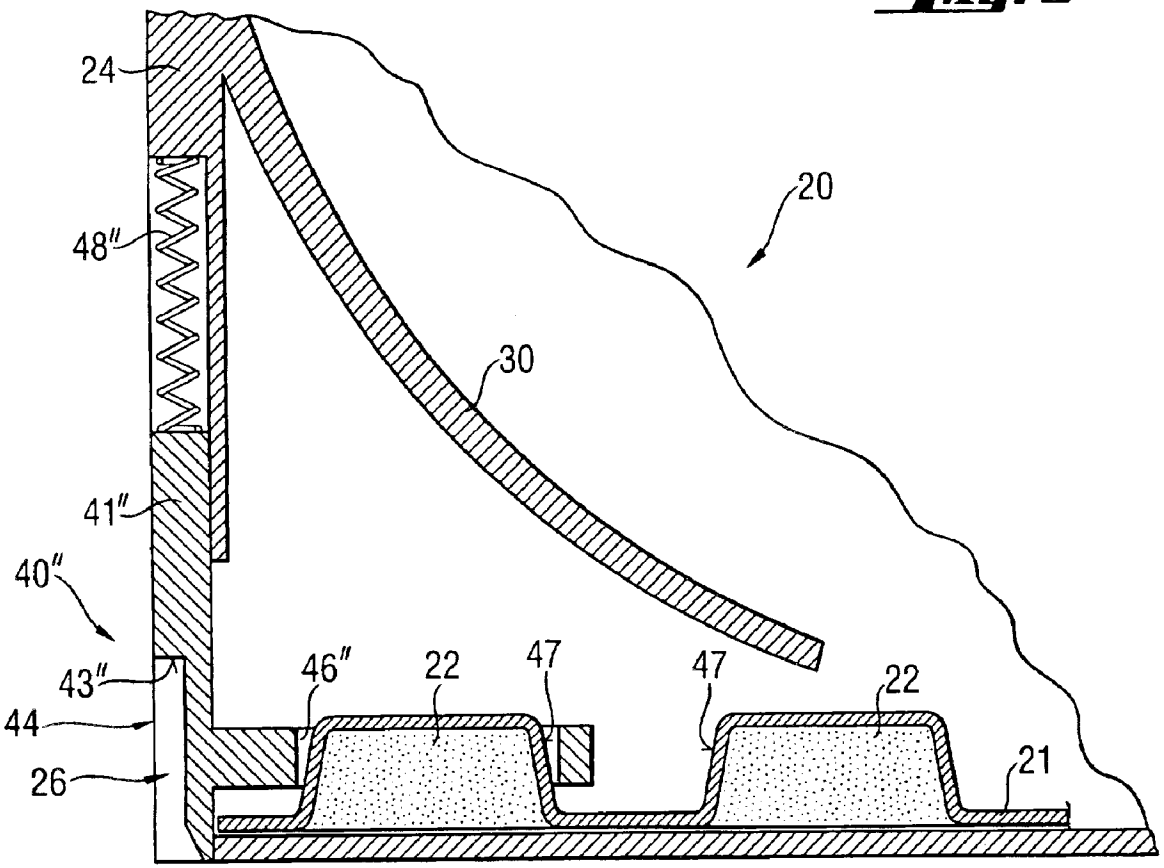
FIG. 9 shows a fourth embodiment of a propellant charge magazine according to the invention in section with cross-sectional presentation.
Figure 10:
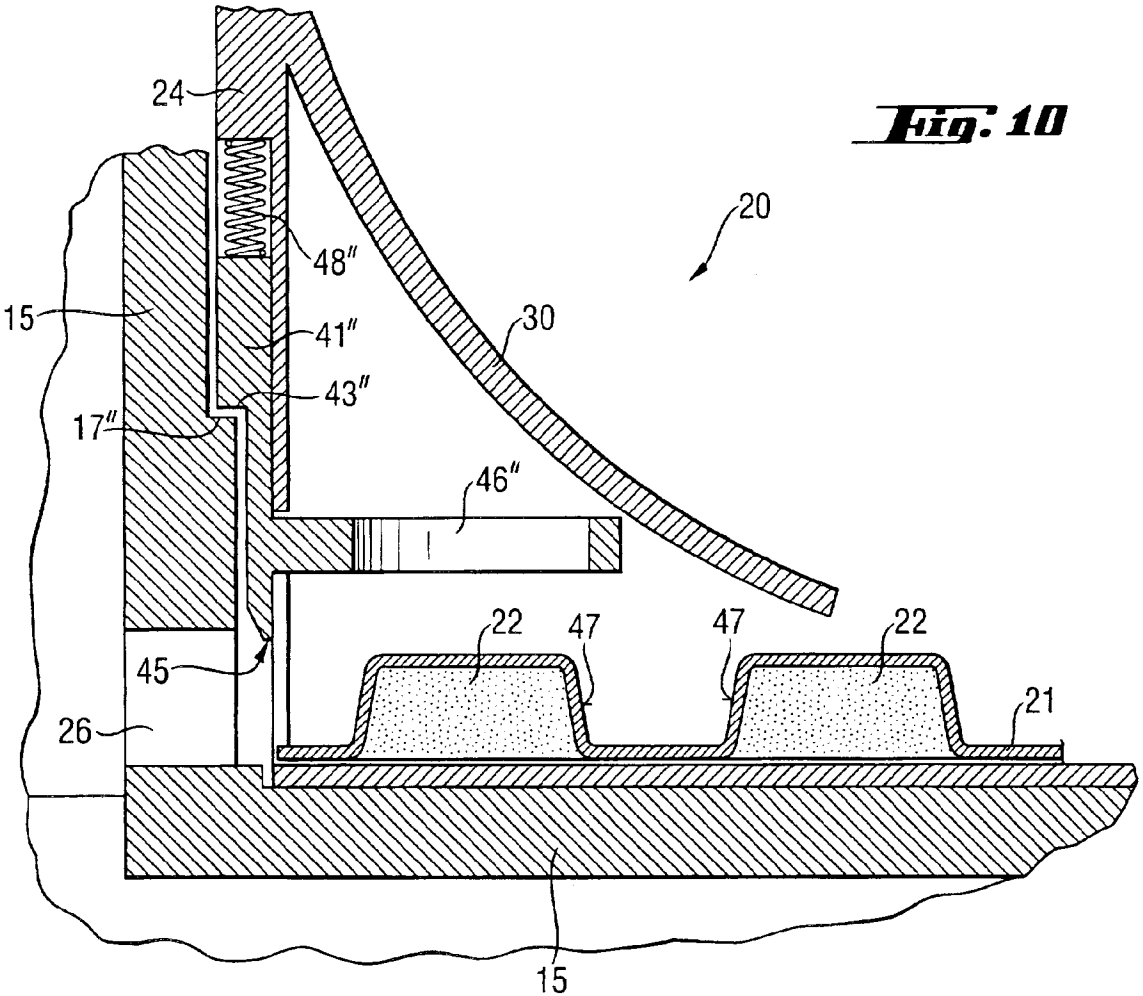
FIG. 10 shows the propellant charge magazine of FIG. 9 in the magazine inlet of a setting tool in cut-out presentation.

FIGS. 9 and 10 represent yet another embodiment of a propellant charge magazine 20 according to the invention. In the area of the output opening 26 of the propellant charge magazine 20, a mechanism 40" is arranged there for positioning the magazine strip 21. This mechanism 40" includes a locking element 41" configured as a locking slider, at which a locking member 46" configured as a locking eyelet is arranged. In the locking position 44 of the mechanism the locking eyelet 46" encompasses a propellant charge 22 occupying this position. The propellant charges of the magazine strip are also used simultaneously as counter locking members 47. The locking slider 41" is spring-biased using a spring element 48" in the direction of its locking position. An edge 43" is provided on the locking slider 41" which co-operates with a locking means 17", for example a counter edge, in the area of the magazine receptacle 15, when the propellant charge magazine 20 is introduced into the magazine receptacle 15 of the setting tool. When this is done, both edges 17" and 43" move towards each other so that the locking slider 41" is urged against the force of the spring element 48" and in such fashion is moved into its release position 45 as shown in FIG. 10. The magazine strip 21 can be further transported in this position. If the propellant charge magazine 20 is again removed from the setting tool, then the locking slider 41" again lowers, whereby the locking eyelet 46" moves once again over a propellant charge 23. The magazine strip 21 is thereby held in a definitive position so that the transport mechanism can again become operational immediately upon insertion of the propellant charge magazine 20 into the setting tool.

FIGS. 11*a* and 11*b* represent a further embodiment of a propellant charge magazine 20 according to the invention. In the case of this propellant charge magazine 20, too, in the forward area, adjacent to the output opening 26 for the magazine strips 21, a mechanism 40'" is provided for positioning the magazine strip 21. This mechanism 40'" encompasses firstly a swivel or locking lever 41'" arranged within, in the propellant charge magazine 20, which acts as a locking element and which is rotationally fixedly connected via a shaft disposed above on the lever (not visible herein) with a locking arm 43'" disposed externally on the housing 24 of the propellant charge magazine 20. In the locking position 44 of the mechanism 40'" the locking lever 41'"encompasses with its locking member 46'" the front and the back zone of a propellant charge 22, which in this exemplary example acts again as the counter locking member 47. A stop 49 is provided on the inside wall of the housing, said stop preventing a pivoting of the locking lever 41'" beyond a certain position. In the opposing pivot direction the locking lever 41'" is fixed using a snap-in point 49" at which the locking arm 43'" abuts is arranged on the outside of the housing 24. This snap-in point 49" can be passed by the locking arm 43'" by the application of a slight force, so that the locking lever 41'" passes from its locking position 44 into its release position 45 (represented in FIGS. 11*a* and 11*b* by the broken line). In order to prevent overshooting the release position a stop 49' is arranged externally on the housing 24 of the propellant charge magazine 20, up to which the locking arm 43'" runs after it has completely passed the snap-in point 49". For moving the locking arm 42'" appropriate means are provided on the magazine receptacle of the setting tool such as, for example, providing a link way over which the lever is moved into the release position 45 when the propellant charge magazine is inserted into a magazine receptacle and using which is moved into the locking position 45 upon extraction of the propellant charge magazine from the magazine receptacle.

FIG. 12 represents a further embodiment of the propellant charge magazine 20 according to the invention. This propellant charge magazine 20 comprises a mechanism 40$^{iv}$ for positioning the magazine strip 21. At the same time, this mechanism also serves for securing the end zone 36 of the magazine strip 21 in the propellant charge magazine 2. The mechanism 40$^{iv}$ encompasses a locking element 41$^{iv}$ arranged on the floor of the propellant charge housing 24, which projects upwards in the transport path of the magazine strip 21. Transport openings are provided in the magazine strip 21 that simultaneously serve as counter locking members 47$^{iv}$. In addition, an opening is provided in the bottom of the housing 24 of the propellant charge magazine 20, through which a locking means 17$^{iv}$ arranged on the magazine receptacle 15 can be passed, when the propellant charge magazine 20 is inserted into the magazine receptacle 15 of a setting tool, as represented in FIG. 12. the propellant charge magazine 20 is then in the release position 45 of the magazine strip 21, in which the magazine strip 21 can be transported out of the propellant charge magazine 20 or can again be pushed back into same. This is done in that the magazine strip is raised over the locking means 17$^{iv}$, so that it passes over the locking element 41$^{iv}$ when being transported. When this is done, advantage is taken of the elasticity of the magazine strip 21.

If the propellant charge magazine 20 is removed from the magazine receptacle 15, and the locking means 17$^{iv}$ moves out of the housing of the propellant charge magazine 20, then the magazine strip 21 sinks, by virtue of its inherent tension in and the bilateral down pressure effected by the guide means 50, so that the locking element 41$^{iv}$ engages with the counter locking member or with the opening 47$^{iv}$. In this locking position transport of the magazine strip is no longer possible (not represented in the drawing).

If the end zone 36 of the magazine strip 21 reaches the mechanism 40$^{iv}$, then the magazine strip 21 is initially raised by the locking element 17$^{iv}$, but the magazine strip 21 again sinks as soon as the opening 38 is situated over the locking means 17$^{iv}$ and the locking element 41$^{iv}$, both of which pass into the opening 38 depending on their dimensions. Continued transport of the magazine strip 21 is thereafter no longer possible.

It remains only to state that, for example, the retaining elements in the end zone of the magazine strip can be configured also, for example, by thickenings in the magazine strip in the end zone, by bending and bonding together two propellant charge sleeves or by adhering a separate piece, such as a piece of felt. Further still, it must be sated that the counter locking members 47 are not configured solely by the propellant charge 21 but can also be formed, for example, by openings in the magazine strip 21, into which the locking elements of the magazine receptacle or the propellant charge magazine engage or by projections, pins, etc.

What is claimed is:

1. A propellant charge magazine for setting tools, comprising a magazine strip carrying propellant charges; and a housing comprising a housing wall defining an internal space for receiving the magazine strip and having at least one opening for introducing the magazine strip into the internal space and for withdrawing the magazine strip therefrom, at least a partially cylindrical guide wall extending from the housing wall within the internal space and dividing the internal space between a first space for receiving a rolled-up magazine strip, and a second, stowage space for accommodating a non-used part of the magazine strip that remained after an initial withdrawal of the magazine strip from the housing upon reintroduction of the non-used part back into the housing; and an opening provided in the at least partially cylindrical guide wall connecting the second space with the first space.

2. A propellant charge magazine according to claim 1, wherein said at least partially cylindrical guide wall is substantially coaxial with a roll-up axis for guiding the rolled-up magazine strip.

3. A propellant charge magazine according to claim 2, further comprising a retaining element for an end zone of the magazine strip provided on the magazine for blocking a complete extraction of the magazine strip from the magazine.

4. A propellant charge magazine according to claim 3, wherein the at least partially cylindrical guide wall has first and second edges limiting the connecting opening, and wherein the first edge, in a withdrawal direction of the magazine strip, forms the retaining element.

5. A propellant charge magazine according to claim 3, wherein the retaining element is formed by an edge of at least one guide rib provided on the magazine.

6. A propellant charge magazine according to claim 3, wherein at least one stop element is provided on an end zone of the magazine strip which is adapted to be engaged by the retaining element when the magazine strip is rolled out of the housing.

7. A propellant charge magazine according to claim 3, wherein the magazine strip (21) has means (39) for transport of the magazine strip (21) by an advance mechanism of a setting tool, and wherein the end zone (36) of the magazine strip (21) has means (38) that provides for an idling operation of the advance mechanism of the setting tool.

8. A propellant charge magazine according to claim 7, wherein the means (38) for providing the idling operation of the advance mechanism encompasses at least one longitudinal opening a length L of which is greater than or equal to a transport stroke (19) of one or each transport member (18, 18$^{1}$) of the advance mechanism.

9. A propellant charge magazine according to claim 1, comprising a mechanism (40–40$^{iv}$) for positioning the magazine strip (21).

10. A propellant charge magazine for setting tools, comprising a magazine strip carrying individual propellant charges; and a housing having an internal space for receiving the magazine strip and having at least one opening for introducing the magazine strip into the internal space and for withdrawing the magazine strip therefrom, the internal space having a first space for receiving a rolled-up magazine strip, and a second, stowage space for accommodating a non-used part of the magazine strip that remained after an initial withdrawal of the magazine strip from the housing upon reintroduction of the non-used part back into the housing; and an opening connecting the second space with the first space; and further comprising a positioning mechanism comprising at least one locking element having a first position in which it engages at least one of the individual propellant charges on the magazine strip and blocks a transport movement of the magazine strip, and a second position in which it releases the at least one of the individual propellant charges on the magazine strip to enable transport of the magazine strip.

11. A propellant charge magazine according to claim 10, wherein the at least one locking element in its first position form-lockingly and/or friction-lockingly engages the at least one of the individual propellant charges on the magazine strip.

12. A propellant charge magazine according to claim 10, wherein the at least one locking element (41–41$^{iv}$), upon insertion of the propellant charge magazine (20) into a magazine receptacle (15) of a setting tool (10), can be switched automatically from the first position (44) thereof into the second position (45) thereof.

13. A propellant charge magazine according to claim 10, wherein the at least one locking element comprises at least one locking member, which in the first position of the locking element engages at least one counter-locking element on the magazine strip.

14. A propellant charge magazine according to claim 10, wherein the at least one locking element is resiliently loaded in a direction of the first position thereof.

15. A propellant charge magazine according to claim 10, wherein the at least one locking element has at least one resilient region.

* * * * *